US005381571A

United States Patent [19]

Gabhart

[11] Patent Number: 5,381,571

[45] Date of Patent: Jan. 17, 1995

[54] PIVOTABLE AND LOCKABLE HOSPITAL BED GUARD

[76] Inventor: Thomas S. Gabhart, P.O. Box 40, Hookerton, N.C. 28538

[21] Appl. No.: 46,224

[22] Filed: Apr. 13, 1993

[51] Int. Cl.[6] ..... A47C 21/08; A61G 7/05

[52] U.S. Cl. ..... 5/430; 5/428; 49/394

[58] Field of Search ..... 5/424–430, 5/93.1; 49/394

[56] References Cited

U.S. PATENT DOCUMENTS

| | | | |
|---|---|---|---|
| 1,062,127 | 5/1913 | Smith . | |
| 2,648,075 | 8/1958 | Chaffin . | |
| 2,751,608 | 6/1956 | Lucas . | |
| 2,817,854 | 12/1957 | Pratt | 5/428 |
| 3,376,066 | 4/1968 | Kernes | 297/417 |
| 4,215,446 | 8/1980 | Mahoney | 5/425 |
| 4,232,415 | 11/1980 | Webber | 5/427 |
| 4,771,492 | 9/1988 | Paine | 5/428 |
| 4,959,878 | 10/1990 | Essek | 5/425 |

FOREIGN PATENT DOCUMENTS

| | | | |
|---|---|---|---|
| 546053 | 6/1942 | United Kingdom | 5/93.1 |

*Primary Examiner*—Alexander Grosz

*Attorney, Agent, or Firm*—Hardaway Law Firm

[57] ABSTRACT

An improvement for a standard hospital bed having a guard rail which provides for gap space, such improvement being a closure mounted on the bed rail at a gap and movable between a first position maintaining the gap and a second position closing the gap to prevent patient movement through such gap.

7 Claims, 4 Drawing Sheets

PIVOTABLE AND LOCKABLE HOSPITAL BED GUARD

BACKGROUND OF THE INVENTION

This invention relates generally to the art of hospital beds and more particularly to a safety apparatus for a hospital bed which would help prevent routine injury to a patient.

Hospital beds typically utilize collapsible guard rails on either side to prevent the patient from rolling out of the bed. The collapsible feature allows the patient normal access to and from the bed, as well as unimpeded medical attention and treatment. One such collapsible guard rail is disclosed in U.S. Pat. No. 4,215,446, and other similar hospital guard rail systems are disclosed in U.S. Pat. Nos. 4,232,415, 2,648,075, 2,751,608, 1,062,127, 4,771,292 and 3,376,066.

While these systems have satisfactorily promoted the safety and convenience needs of many patients, there remains room for improvement for the overall security and well-being of patients in a hospital bed.

SUMMARY OF THE INVENTION

It is thus an object of this invention to provide a bed guard which reduces the potential for patient injury.

It is a further object of this invention to provide an improved hospital bed guard which closes gaps associated with conventional hospital bed guard rails.

It is a further and more particular object of this invention to provide a novel rotating apparatus which can be used to close gaps associated with a hospital bed guard rail of a standard hospital bed.

These as well as other objects are accomplished by an improvement for a bed having at least one guard rail on a side and at least one gap adjacent to the guard rail, the improvement being a closure having a first end which further defines a rotation means carried by the guard rail, a first locking means for securing the closure in a first locking position which maintains the associated gap, a second locking means for securing the closure in a second locking position closing the gap, and a means for engaging the first and second locking means.

DETAILED DESCRIPTION

In accordance with this invention it has been found that the potential for patient safety is increased by providing a hospital bed guard for use in association with conventional hospital guard rails to close gaps about the perimeter of a standard hospital bed.

Various other features and advantages will become apparent from a reading of the following description given with reference to the various figures of drawings.

Figure 1:
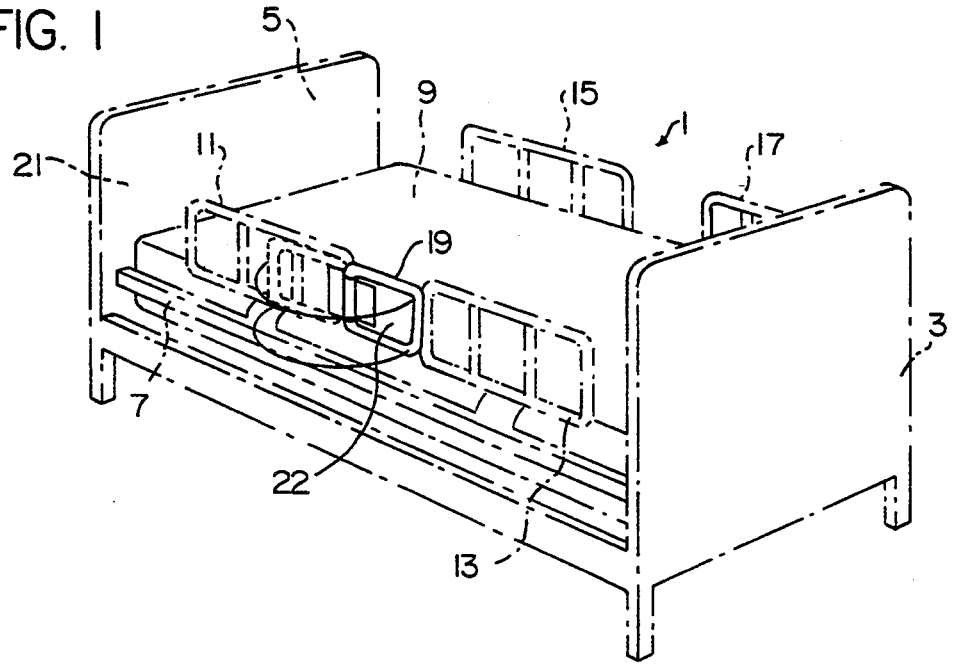
FIG. 1 of the drawings is a perspective view of a standard hospital bed with conventional guard rails having the improvement of this invention mounted thereon.

FIG. 1 of the drawings illustrates a standard hospital bed 1 having a headboard 3 and footboard 5. Illustrated along longitudinal sides 7 and 9 of the bed are conventional, collapsible bed guard rails 11, 13, 15 and 17. Gaps exist about the perimeter of the bed between adjacent rails and between the rails and headboard or footboard. For example, gap 19 exists between foot rail 11 and head rail 13 and gap 21 exists between footboard 5 and foot rail 11. Smaller patients, and particularly limbs of patients, can become lodged in such gaps causing injury and trauma which can be minimized by the apparatus of this invention.

Closure 22, functioning as a rotatable hospital bed guard, is illustrated in FIG. 1 mounted on foot rail 11 at gap 19. Closure 22 is rotatable between two positions with one position maintaining the gap 19 and the other position closing the gap 19.

Figure 2:
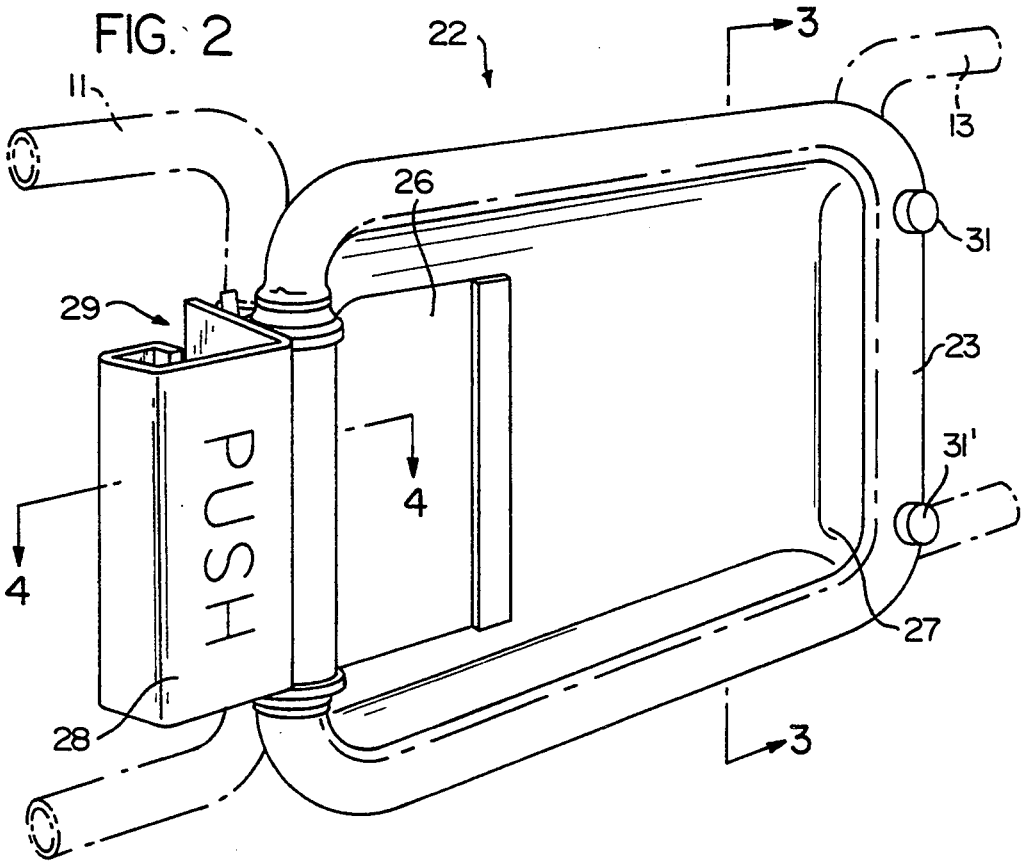
FIG. 2 of the drawings is a perspective view of the improved apparatus in accordance with this invention.

FIG. 2 of the drawings shows closure 22, comprising tubular frame 23 about the perimeter of sheet metal plate 27, mounted on foot rail 11. Plate 27 defines an opening 26 which reversibly houses handle 28 of locking mechanism 29. Locking mechanism 29 is shown in a second locking position, such that closure 22 closes the gap between foot rail 11 and head rail 13.

Figure 3:
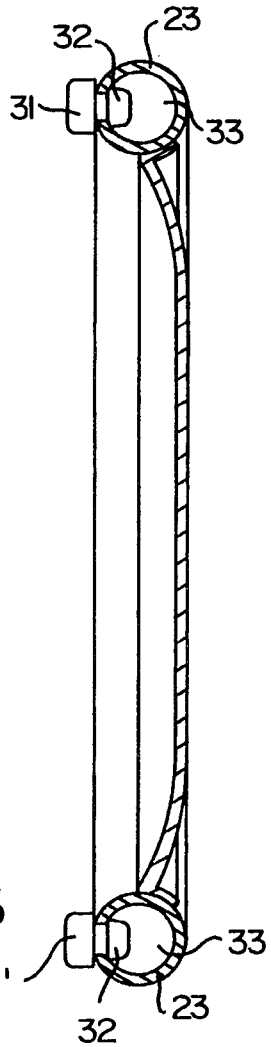
FIG. 3 of the drawings is a cross-sectional view along the line 3—3 of FIG. 2.

In FIGS. 2 and 3 of the drawings, rubber stops 31 and 31' are illustrated secured to the tubular frame 23. FIG. 3 further shows the attachment means of stops 31 and 31' comprising an extended portion 32 thereof positioned through tubular frame 23 and into the cavity 33 defined by hollow tubular frame 23. The rubber stops function to cushion the contact between the bed guard and bed rail when the bed guard is in the first locking position.

Figure 4:
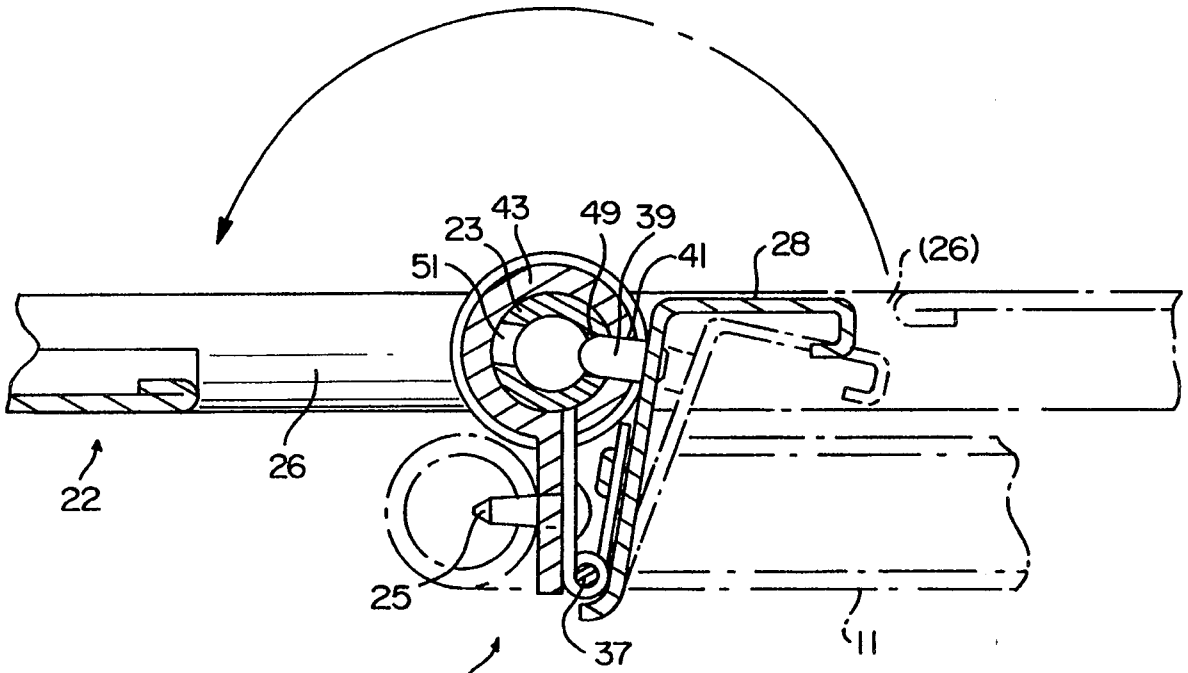
FIG. 4 of the drawings is a sectional view along the line 4—4 of FIG. 2, showing the rotational feature of the apparatus in accordance with this invention.

FIG. 4 of the drawings shows closure 22 having rotated from its first locking position into its second locking position such that the associated gap at the perimeter of the bed is closed. Locking mechanism 29 is secured to bed guard rail 11 by attachment means 25. Spring hinge 37 allows locking pins 39 of locking mechanism 29 to reversibly engage pin channels 41 defined by tubular casing 43. The rotation means as seen in FIG. 4 comprises tubular casing 43 which houses the rotatable tubular frame 23 next adjacent opening 26, such that tubular frame 23 rotates about the axis of tubular casing 43. Tubular frame 23 defines pin channels 49 and 51.

Figure 6:
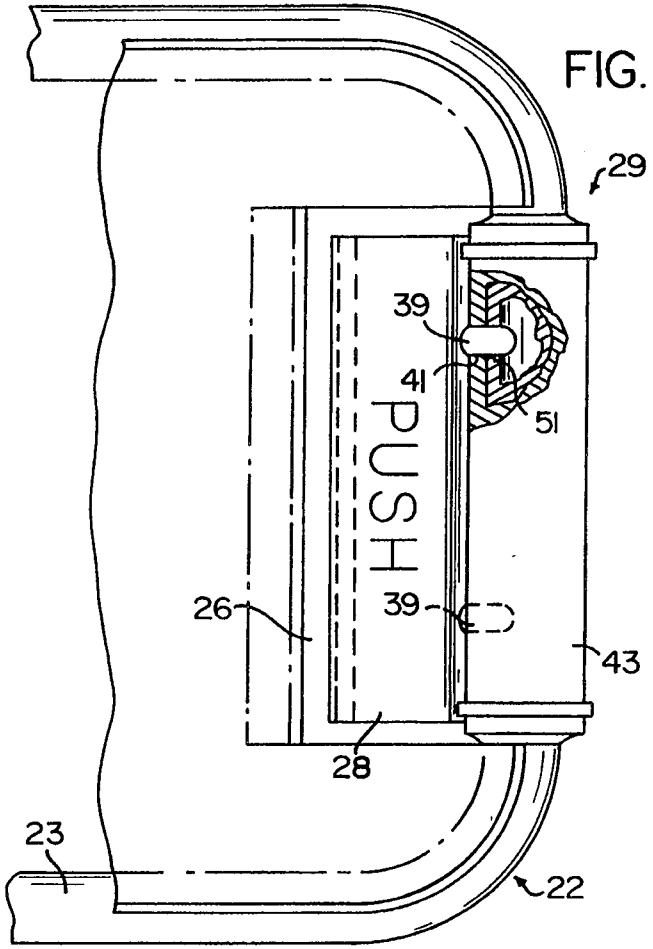
FIG. 6 of the drawings is an elevation view of the improvement of this invention in a first locking position showing the locking feature in partial section.
Figure 5:
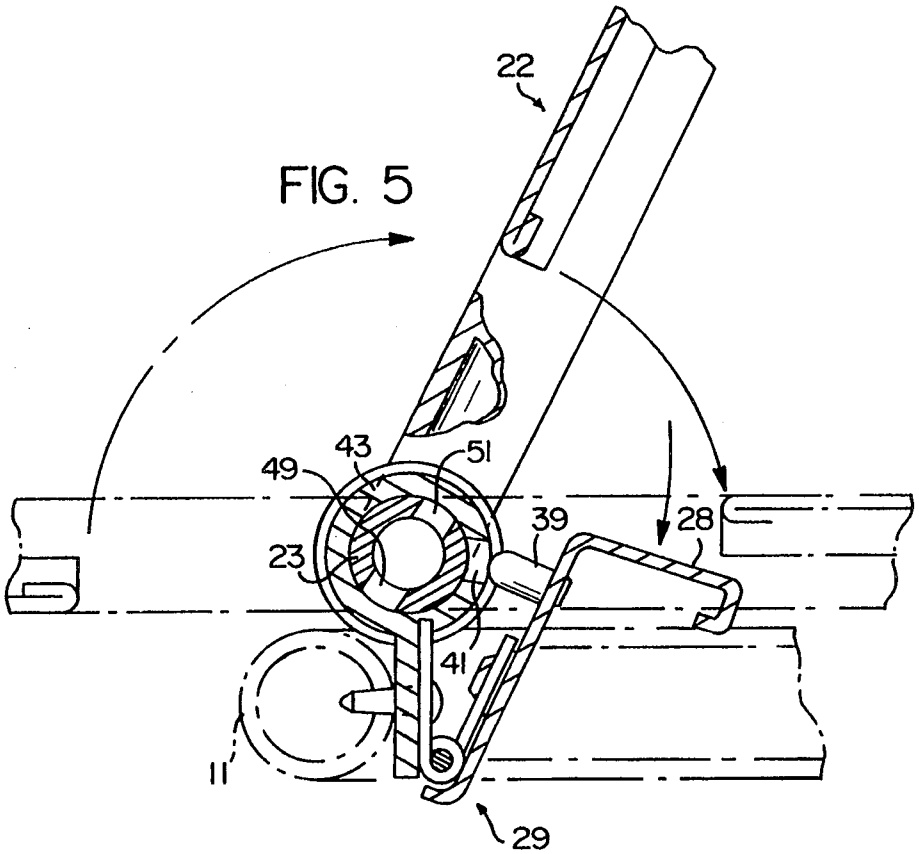
FIG. 5 of the drawings is a second sectional view along the line 4—4 of FIG. 2, showing the apparatus in accordance with this invention in partial rotation.

A first locking means, as seen in FIGS. 5 and 6 of the drawings, comprises locking mechanism 29, locking pins 39, pin channels 51 of tubular frame 23 and pin channels 41 of tubular casing 43. This first locking means secures closure 22 in its first locking position when locking pins 39 engage pin channels 51 aligned with pin channels 41. In its first locking position, closure 22 maintains the associated gap at the perimeter of the bed, allowing access to the guard rails and thereby to the patient. FIG. 5 of the drawings illustrates closure 22 rotating toward this first locking position.

When it is desirable to close the associated gap, the locking mechanism 29 is accessed at handle 28, such that locking pins 39 disengage pin channels 51 and pin channels 41. Closure 22 is then free to rotate about the axis of its first end, outward from bed 1, to stop at its second locking position.

Figure 7:
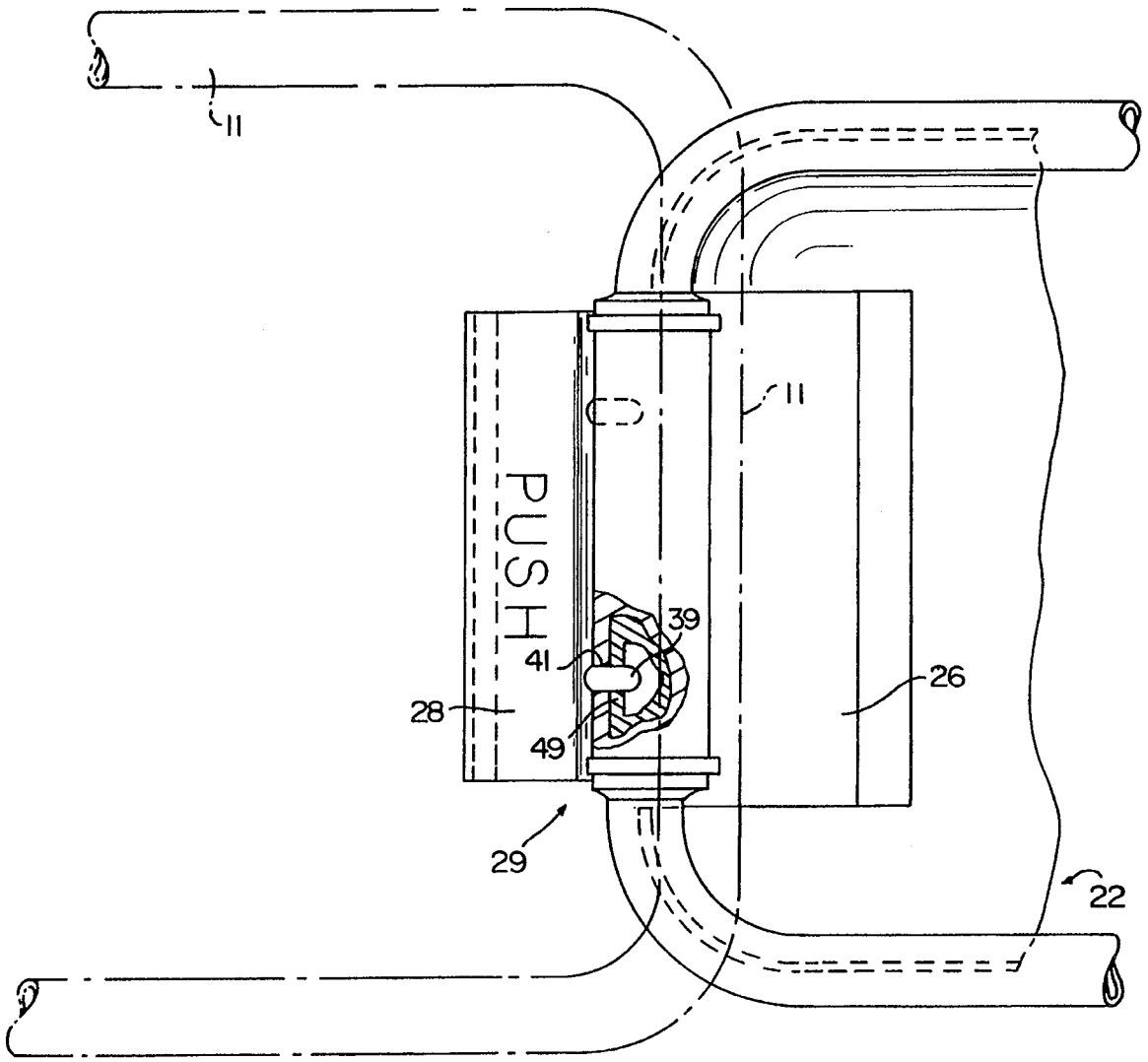
FIG. 7 of the drawings is an elevation view of the improvement of this invention in a second locking position showing the locking feature in partial section.

A second locking means as seen in FIGS. 2, 4 and 7 comprises locking mechanism 29,locking pins 39, pin channels 49 of tubular frame 23 and pin channels 41 of tubular casing 43. The second locking means secures closure 22 in its second locking position when locking pins 39 engage pin channels 49 aligned with pin channels 41. When closure 22 is in its second locking position, the associated gap at the perimeter of the bed is closed, allowing for maximum security of the patient.

The closure 22 can be returned to its first locking position by again accessing handle 28, which disengages locking pins 39 from aligned pin channels 49 and pin channels 41, allowing closure 22 to rotate 180° about the axis of its first end, outward from hospital bed 1. Means for engaging both locking means is seen in FIG. 5 as handle 28 and the extension of handle 28 carrying spring hinge 37.

FIGS. 6 and 7 further illustrate the orientation of locking pins 39 when closure 22 is secured in its first and second locking positions, respectively. In FIG. 6, pin channels 51 are aligned with pin channels 41. In FIG. 7, pin channels 49 are aligned with pin channels 41.

Mounting the closure on a bed in order to close the gap between a bed rail and either the footboard or headboard serves to further extend the safety feature of the guard rails. The closure described herein can be mounted in such ways as to secure all gaps associated with the perimeter of bed 1, indicating the versatility of the apparatus of this invention. The orientation of the closure may be adjusted depending upon which gap is to be maintained and closed. For example, as shown in FIG. 1, gap 21 can be maintained or closed when closure 22 is mounted on guard rail 11 next adjacent footboard 5 by adjusting the orientation of closure 22 with respect to guard rail 11.

The rotating closure 22, herein described as a bed guard, can also function to define or close gaps other than those associated with the perimeter of a hospital bed.

It is thus seen that the apparatus of this invention provides an improvement to a standard hospital bed having conventional bed rails so as to reduce the likelihood of patient injury from movement through gaps about the perimeter of the bed. As many variations will become apparent to those of skill in the art from a reading of the foregoing disclosure which is exemplary in nature, such variations are embodied within the spirit and scope of this invention as defined by the following appended claims.

That which is claimed:

1. In a bed having at least one guard rail on a side of said bed and at least one gap adjacent to said guard rail, a gap closure apparatus comprising:

a closure having a first end, said first end further defining a rotation means, said rotation means being carried by said guard rail;

a first lock for securing said closure in a first locking position with the closure means adapted to be positioned adjacent to, generally parallel to, and coextensive with the guard rail, thereby maintaining said gap;

a second lock for securing said closure in a second locking position, closing said gap said first and said second locks being operated by a single handle. and means for engaging said first and said second locking means.

2. In a hospital bed having a headboard, a footboard, longitudinal sides between said headboard and said footboard, and at least one collapsible guard rail on one said side of said bed said guard rail being of a height low enough to allow someone to reach a person lying on the bed, yet high enough to prevent the person lying on the bed from falling off the bed at least one gap defined adjacent said guard rail, the improvement comprising:

a rotating closure mounted upon said guard rail of said bed at said gap, movable between two positions, a first of said positions maintaining said gap and a second of said positions closing said gap, and a lock having a portion for maintaining said rotating closure in one of said first or second position.

3. The improvement according to claim 2 further comprising:

two collapsible guard rails on the same side of said bed structure with said rotating closure mounted upon a first of said guard rails of said bed whereby a gap defined between said guard rails is closed by positioning said rotating closure in said second position.

4. The improvement in accordance with claim 2 wherein said closure comprises:

a generally rectangular tubular frame having a side section defining a plurality of pin channels;

a locking mechanism rotatably communicating with said tubular frame whereby said closure is rotatable between said first position and said second position.

5. The improvement in accordance with claim 4 further comprising a locking mechanism to lock said closure, said locking mechanism comprising:

a handle;

an extension of said handle carrying a spring hinge and terminating in a tubular casing;

a plurality of locking pins attached to said handle extension;

a plurality of pin channels defined by said tubular casing;

wherein said tubular casing houses said side section of said tubular frame and said locking pins of said locking mechanism reversibly engage said pin channels of said tubular casing aligned opposite said pin channels of said tubular frame.

6. The improvement in accordance with claim 2 further comprising two rubber stops mounted on said rotating closure.

7. In a bed having at least one guard rail on a side of said bed and at least one gap adjacent to said guard rail, said guard rail being of a height low enough to allow someone to reach a person lying on a bed, yet high enough to prevent the person lying on the bed from falling off the bed, a gap closure apparatus comprising:

a closure having a first end, said first end further defining a rotation means, said rotation means being carried by said guard rail;

a first lock for securing said closure in a first locking position, maintaining said gap;

a second lock for securing said closure in a second locking position, closing said gap;

said first and said second locks being operated by a single handle.

* * * * *